US009079179B2

(12) United States Patent
Wimberger-Friedl et al.

(10) Patent No.: US 9,079,179 B2
(45) Date of Patent: Jul. 14, 2015

(54) MICROFLUIDIC DEVICE COMPRISING SENSOR

(75) Inventors: Reinhold Wimberger-Friedl, Veldhoven (NL); Christiane Rossetta Maria De Witz, Lommel (BE)

(73) Assignee: Koninklijke Philips N.V., Eindhoven (NL)

( * ) Notice: Subject to any disclaimer, the term of this patent is extended or adjusted under 35 U.S.C. 154(b) by 740 days.

(21) Appl. No.: 13/262,942

(22) PCT Filed: Apr. 9, 2010

(86) PCT No.: PCT/IB2010/051534

§ 371 (c)(1),
(2), (4) Date: Jan. 9, 2012

(87) PCT Pub. No.: WO2010/119380

PCT Pub. Date: Oct. 21, 2010

(65) Prior Publication Data

US 2012/0115246 A1 May 10, 2012

(30) Foreign Application Priority Data

Apr. 15, 2009 (EP) ..... 09157982

(51) Int. Cl.
*B01L 3/00* (2006.01)

(52) U.S. Cl.
CPC ..... *B01L 3/50273* (2013.01); *B01L 3/5027* (2013.01); *B01L 3/502746* (2013.01); *B01L 2300/0627* (2013.01); *B01L 2300/0825* (2013.01); *B01L 2300/0877* (2013.01); *B01L 2300/0887* (2013.01); *B01L 2400/0406* (2013.01)

(58) Field of Classification Search
CPC ..... B01L 2300/0681; B01L 3/50273; B01L 2300/0825; B01L 3/502746; B01L 2300/0816; B01L 2300/0877; B01L 3/5027; B01L 2300/0861; B01L 3/502715; B01L 2200/10; B01L 2300/0636; G01N 15/1484; G01N 2001/4088; G01N 35/00029; G01N 30/6091; G01N 33/491
USPC ..... 422/68.1, 423, 947, 255, 502; 435/287.1, 287.7, 288.3; 436/169, 178
See application file for complete search history.

(56) References Cited

U.S. PATENT DOCUMENTS

| | | | |
|---|---|---|---|
| 5,208,163 | A | 5/1993 | Charlton |
| 6,436,722 | B1 | 8/2002 | Clark |
| 6,499,499 | B2 | 12/2002 | Dantsker |

(Continued)

FOREIGN PATENT DOCUMENTS

| | | | |
|---|---|---|---|
| DE | 102006038271 | A1 | 2/2008 |
| EP | 0806666 | A2 | 11/1997 |

(Continued)

*Primary Examiner* — Melanie Y Brown
*Assistant Examiner* — Erik B Crawford

(57) ABSTRACT

A microfluidic device for performing detection of a substance in a liquid sample includes a cavity (24) formed above a sensor surface area (22) of a sensor (18). The cavity (24) extends at the first side of a base plate (10) from a first area (32), where the cavity overlaps a first lateral channel part (30), to a second area (34), where the cavity overlaps a second lateral channel part (36). The second lateral channel part (36) includes a lateral channel part formed by a porous capillary suction structure (13). The cavity (24) forms a flow path (42) from the first lateral channel part (30) along the sensor surface area (22) to the second lateral channel part (36).

7 Claims, 3 Drawing Sheets

(56) References Cited

U.S. PATENT DOCUMENTS

| | | | | |
|---|---|---|---|---|
| 7,189,522 | B2 | 3/2007 | Esfandiari | |
| 2002/0176804 | A1 | 11/2002 | Strand | |
| 2004/0115831 | A1 | 6/2004 | Meathrel | |
| 2005/0084982 | A1 * | 4/2005 | Brauner | 436/514 |
| 2006/0263242 | A1 | 11/2006 | Yang | |
| 2007/0092411 | A1 | 4/2007 | Lench | |

FOREIGN PATENT DOCUMENTS

| | | | |
|---|---|---|---|
| EP | 1760465 | A1 | 3/2007 |
| GB | 2208324 | A1 | 3/1989 |
| WO | 2006054238 | A2 | 5/2006 |
| WO | 2007060580 | A1 | 5/2007 |
| WO | 2008009952 | A2 | 1/2008 |

* cited by examiner

MICROFLUIDIC DEVICE COMPRISING SENSOR

FIELD OF THE INVENTION

The invention relates to the field of microfluidic devices, and more specifically to a microfluidic device for performing detection of a substance in a liquid sample, a method of using such microfluidic device, and a method of manufacturing a microfluidic device.

BACKGROUND OF THE INVENTION

Lateral flow assays are the most frequently used formats for immunosensors, such as, for example, the pregnancy test in urine, or the drug test in saliva. There, the flow is created by a piece or sheet of paperlike material, like nitrocellulose, microporous nylon, etc. The microporosity of the sheet material creates a strong capillary action without the necessity of micromachined parts. It can operate in an open system and in large thickness and, thus, big volume. Flow rates are determined by the capillary force, which is inversely proportional to the pore size, and the effective aperture, which depends on the cross-section of the material perpendicular to the flow direction and the filling ratio or the porosity. The flow resistance scales with the inverse of the square of the pore size at constant aperture. With decreasing pore size, the resistance increases stronger than the capillary force, so that the apparent flow rate decreases. In a typical arrangement of a lateral flow assay device, different zones are present for the different functions, and different porous materials are used in the different sections.

From WO 2006/054238 A2 (US 2008/0185043A1), a microfluidic device for guiding the flow of a fluid sample is known that comprises a base plate that extends in two lateral directions and has a least one through-going recess in the vertical direction, a flow-through unit that has at least a first and a second flow-through site, and a plate structure. The flow-through unit is arranged relatively to the recess of the base plate so that a vertical fluid flow from one side of this arrangement to the opposite side through each of the first and the second flow-through sites and through a linking channel cavity formed between the flow-through unit and the plate structure is enabled. In the plate structure, an active component such as a sensor, an actuator or a pump may be integrated.

SUMMARY OF THE INVENTION

It would be desirable to facilitate the use of sensors on solid functional substrates in microfluidic devices for performing detection of a substance in a liquid sample.

Conventional lateral flow systems with porous media allow easy handling and have a scalable volume. The local convection is high due to the small pore size, which allows a fast binding reaction. Their drawback is the high background and difficult washing. More importantly, new sensitive detection principles, like electric, GMR, evanescent waveguide or scanning confocal laser, require a solid and functional substrate and are thus incompatible with porous media. It would be desirable to minimize or avoid the mentioned disadvantages of conventional lateral flow systems. It would also be desirable to combine one or more advantages of conventional lateral flow systems with the use of sensors on solid functional substrates.

It would be desirable to provide a fluidic arrangement for a biosensor which is scalable in volume, has a high convection, and can be combined with solid substrate sensors.

To better address one or more of these concerns, in a first aspect of the invention, a microfluidic device for performing detection of a substance in a liquid sample is provided that comprises:

- a base plate,
- a first lateral channel part extending along a first side of the base plate,
- a second lateral channel part extending along the first side of the base plate,
- and a sensor with a sensor surface area,
- wherein the second lateral channel part comprises a lateral channel part that is formed by a porous capillary suction structure,
- and wherein a cavity is formed above the sensor surface area, at least a part of the cavity being formed in the base plate,
- said cavity extending at the first side of the base plate from a first area, where the cavity overlaps the first lateral channel part, to a second area, where the cavity overlaps the second lateral channel part,
- the cavity forming a flow path formed the first lateral channel part along the sensor surface area to the second lateral channel part.

In particular, the first lateral channel part is in open fluid communication with the cavity, and the second lateral channel part is in open fluid communication with the cavity.

The term "porous capillary suction structure" is to be understood as a structure, e.g. a medium or a material, which has a porosity that enables liquid transport by capillary suction. For example, the structure may be formed by an inherently microstructured medium, e.g. a paperlike material such as microcellulose or microporous nylon. Further, the structure may be a micromachined microstructured structure, e.g. a micromachined surface structure. The porous capillary suction structure may be a porous material, e.g. a porous pad. Such porous pads are, for example, known from conventional lateral flow assays.

For example, the second lateral channel part forms a flow path for receiving liquid from the cavity. Because of the porous capillary suction structure, the second lateral channel part may form a flow path for drawing or pumping liquid from the cavity by capillary force, i.e. capillary action.

The term "capillary force" is to be understood as meaning the force that causes, due to surface tension and/or interfacial tension acting at a liquid surface, e.g. at a flow front, the movement of liquids in thin channels or through porous media.

For example, the sensor is a sensor for performing detection of a substance in a liquid sample at the sensor surface area, that is, in contact with and/or in proximity to the sensor surface area.

For example, the sensor surface area is an active sensor surface or a sensing surface area, that is, the sensor is arranged to detect the presence of said substance, or of markers or labels attached to said substance, on the sensor surface area.

For example, the sensor surface area comprises specific receptors or binding sites for the substance to be detected. For example, the sensor surface area comprises specific receptor molecules or binding sites for target molecules, i.e. molecules of the substance to be detected. For example, the sensor surface area may comprise antibodies for the target molecules.

In biosensors, typically, the presence of a certain (bio-) chemical substance in a liquid sample is detected by specific recognition of the target molecule and creation of a physical effect based on the recognition. In most cases, for example, the target molecules are immobilized and, thus, accumulated at the surface. In this way, very low concentrations of target molecules can be detected. In order to achieve the immobilization, the target molecules need to diffuse to the surface, where a binding reaction takes place. In order to create a measurable signal indicating the binding of the targets, for example, a label is attached to the target via a specific recognition reaction. For example, the label may be a dye molecule or a magnetic bead. In many cases, this is done in a separate step, in which the label needs to diffuse to the surface like the target did in the first step. Alternatively, the label may be bound to the target in solution, and the obtained adduct is immobilized at the surface afterwards.

In order to provide an efficient reaction, label concentrations may be higher than target concentrations. Thus, after the binding step, excess labels may still be present in solution. When the surface is a sensor surface, excess labels present in the liquid above the sensor surface may lead to a sensor signal irrespective of the presence of the target. Furthermore, labeled species may bind to the sensor surface in a non-specific way. This process may also lead to a sensor signal irrespective of the presence of the target. This so called background signals similar limit the detection limit of the sensor. In order to obtain a good performance of the sensor, it is therefore advantageous to wash away non-specifically bound label species and/or replace the label containing fluid by another medium, such as a washing buffer or air.

For example, the microfluidic device according to the invention may improve the performance of a biosensor by providing one or more of the following advantageous effects:

(i) By enhancing diffusion by convection, local depletion at the sensor surface may be minimized or avoided. This can improve the binding of targets, which relies on the transport of the molecules to the sensor surface.

(ii) By providing high shear forces created by the flow, the pulling of non-specifically bound label species from the surface may be improved. Thus, the removing of non-specifically bound label species from the surface by washing may be improved. For example, washing may be done a separate washing buffer, but also with the sample liquid itself.

(iii) An efficient removing of liquid containing labels may be facilitated. This is advantageous, because, depending on the sensor type, the measured signal may be effected by the presence of labels in the fluid in front of the sensor surface.

In porous media, which are frequently used to transport liquids by capillary forces, there is a huge surface area. Thus, when an immobilized liquid layer is attached to that huge surface area, it is more difficult to remove labels than in a comparatively smooth channel.

Due to the Poiseulle flow in channels, the residence time distribution of molecules may be very broad. In particular, liquid elements close to the surface take a very long time to travel through the channel. Therefore, flow in a channel has to be kept up for a long time.

Because of the porous capillary suction structure of the microfluidic device according to the invention, liquid may be pumped from the cavity and, thus, the flow rate in the cavity may be higher than what could be achieved with a hollow channel alone, and without an external pump.

Thus, in the cavity, diffusion may be enhanced by convection, and, thus, local depletion of molecules at the surface may be minimized or avoided. Thus, the binding of target molecules, which relies on the transport of the molecules to the surface, may be improved.

Further, due to a higher flow rate, washing is improved, because shear forces created by the flow are higher and, thus, facilitate pulling non-specifically bound labels from the surface. For example, washing can be done by a separate washing buffer, but also with the sample liquid itself.

Furthermore, because of the cavity above the sensor surface area, superfluous liquid containing the labels may be removed efficiently, as will be explained in the following: due to the Poiseulle flow in channels, the residence time distribution of liquid elements or labels is very broad. Thus, liquid elements close to the surface take a very long time to travel through a channel. Therefore, the flow has to be kept up for a long time in order to remove labels. Whereas in porous media, which are frequently used to transport liquids by capillary forces, there is a huge surface area with an immobilized liquid layer attached to it, in the cavity above the sensor surface area labels may be removed much easier. Thus, the presence of labels in the liquid above the sensor surface area may be reduced. Therefore, depending on the sensor type, the background of the sensor signal may be decreased.

Because the cavity extends at the first side of the base plate form the first area, where the cavity overlaps the first lateral channel part extending along the first side of the base plate, to the second area, where the cavity overlaps the second lateral channel part extending along the first side of the base plate, the cavity is arranged close to the first and second lateral channel parts. For example, the first and second lateral channel parts may be in direct contact to the cavity. Thus, the deviation of the flow along the sensor surface area from a strictly lateral flow from the first lateral channel part to the second lateral channel part is small. A laminar fluid flow may be facilitated.

Furthermore, the microfluidic device may have a flat and compact structure, because at least a part of the cavity is formed in the base plate.

Furthermore, because the second lateral channel part extends along the first side of the base plate and at least a part of the cavity is formed in the base plate, the lateral channel part comprising the porous capillary suction structure may extend above the cavity. In this case, the porous capillary suction structure, e.g. a membrane based lateral flow pad, will not fill the cavity, because at least a part of the cavity is formed in the base plate and, thus, below the porous capillary structure. Therefore, the manufacturing tolerances are relaxed, in particular, the tolerances of size and position of the porous capillary suction structure. Thus, a simple manufacturing process of a reliable microfluidic structure is facilitated.

For example, the first lateral channel part forms a flow path for supplying liquid to the cavity.

For example, the first lateral channel part has a structure that is adapted to transport the liquid by capillary force, i.e. by capillary suction. Thus, a sample liquid may be autonomously transported to the cavity without an external pump.

The term "cavity" is to be understood as meaning an unfilled space for receiving at least a part of the liquid sample. In particular, e.g., a substantial volume of the cavity is free from microporous structures. In particular, for example, a substantial volume adjacent to the sensor surface area is free from microporous structures. For example, a sensor surface area may comprise a smooth surface.

For example, the cavity has a structure that is adapted to transport the liquid by capillary suction. In particular, the cavity may have cross-sectional dimensions that enable transporting the liquid by capillary suction.

For example, at least at the first side of the base plate, the cavity extends laterally from the first area to the second area. For example, the first and second lateral channel parts are arranged at the same side of the cavity. For example, the first and second lateral channel parts are arranged parallel to each other. For example, the lateral channel parts are arranged vertically offset with regard to the cavity. For example, the microfluidic device may comprise a top plate that extends along the first and second lateral channel parts opposite to the base plate. Thus, a closed flow path system from the first lateral channel part to the second lateral channel part may be provided.

For example, the porous capillary suction structure is adapted to exert a capillary force $F_c$ on the liquid, and the cavity is adapted to exert a capillary force $F_2$ on the liquid, $F_c$ being greater than $F_2$. For example, $F_c$ may be greater or equal $2\times F_2$. Thus, a high flow rate in the cavity may be achieved. Thus, the porous capillary suction structure provides a higher flow rate in the cavity than could be achieved by, for example, a lateral extension of the cavity alone.

This is in particular advantageous in order to provide a simple, disposable device in which the sample fluid or liquid is driven passively, e.g. by capillary force only.

For example, in a conventional device driven by a hollow channel of the height h, the capillary pressure $p_c$ is inversely proportional to the channel height h. In particular, $p_c=\sigma \cos \Theta/h$, with $\sigma$ being the surface tension of the fluid and $\Theta$ the contact angle of the fluid with the channel wall. Therefore, the channel has to be shallow. In addition, convection of the sample liquid at the sensor surface is required to avoid local depletion. This is referred to as the diffusion limitation. The volumetric flow rate and, accordingly, the required total volume increase with the square of the channel height. For many applications, large sample volumes are required, because for low target concentrations, the sample volume needs to be high in order to have a statistically significant binding probability. However, larger sample volumes lead to unacceptably large footprints of the device. This is especially a problem on the receiver or waste side, since the capillary force needs to be strong there to pull the flow.

For example, according to the invention, a vertical extension of the cavity may be limited at a level that is substantially equal to a level of a surface of the first side of the base plate. Then, the cavity extends vertically below the surface of the first side of the base plate. Thus, for example, the vertical extension of the cavity and/or the cross section of the cavity may be chosen or adjusted independently of the vertical extension of the second lateral channel part. For example, the vertical extension of the cavity may be smaller than the vertical extension of the second lateral channel part.

For example, the sensor does not protrude above the first side of the base plate.

The cavity extends at the first side of the base plate from the first area to the second area. Thus, the cavity comprises an opening in the first side of the base plate, which opening extends from the first area to the second area.

For example, the cavity may be formed by a through-going opening in the base plate that is closed at a side opposite to the first side of the base plate. Alternatively, for example, the cavity may be formed by a non-through-going recess in the first side of the base plate, in which recess the sensor is arranged.

For example, below an upper first side of the base plate, the cavity is surrounded by a liquid-tight wall. For example, the wall may comprise the sensor and/or the sensor surface area. Thus, a closed flow path from the first lateral channel part along the sensor surface area to the second lateral channel part is provided.

In one embodiment, the cavity is in immediate contact with the porous capillary suction structure. For example, the porous capillary suction structure may vertically delimit the cavity.

For example, the sensor may be one of a group consisting of a giant magnetoresistance (GMR) sensor, a complementary metal-oxide-semiconductor (CMOS) sensor, an evanescent wave guide sensor, an amperometric sensor, a dielectric sensor, a scanning confocal laser sensor, an optical sensor, and a fluorescence sensor. For example, the sensor may be a total internal reflection fluorescence (TIRF) sensor or a frustrated total internal reflection (fTIR) sensor. For example, the sensor is a biosensor, that is, a sensor for detecting a biochemical substance.

For example, the sensor may comprise a sensor substrate, the sensor surface area being arranged at a surface of the substrate.

For example, the sensor is an electronic sensor and/or an optical sensor.

For example, conductive paths, which are connected to an electronic sensor, are arranged at the base plate. For example, the conductive paths may be arranged at a second side of the base plate, opposite to the first side of the base plate. For example, the sensor may comprise a sensor substrate, the sensor surface area being arranged at a surface of the substrate, and terminals of the sensor may be arranged at/on the substrate.

For example, an optical sensor may comprise a transparent or translucent sensor substrate, the sensor surface area being arranged at a surface of the substrate. The optical sensor may be part of an optical detection arrangement comprising, e.g., a light detecting unit and/or a light source for illuminating the sensor surface area. For example, the light source may be arranged to illuminate the sensor surface area through the sensor substrate. For example, the light detecting unit may be arranged to detect light emitted from the sensor surface area through the sensor substrate, e.g. light emitted by labels or molecules attached to the sensor surface area. For example, the microfluidic device may comprise a light detecting unit and/or a light source and/or the optical detection arrangement. Alternatively or additionally, the sensor substrate may be arranged to be illuminated by light from an external light source, and/or be arranged to output light emitted from the sensor surface area. The term "light" is to be understood as comprising visible light as well as light of other wavelengths associated with the respective sensor type, such as IR light or UV light.

Thus, for example, the first and second lateral channel parts are arranged on the first side of the base plate, and the base plate may comprise a through-going opening, a sensor being mounted on the other side of the base plate. Thereby, the cavity may be created above the sensor surface area within the opening in the base plate. Thus, a simple structure of the microfluidic device is achieved, e.g. the cavity may be realized by simply providing an opening in the base plate. This is advantageous, because many new biosensor concepts, such as GMR, evanescent waveguide, amperometric, dielectric, etc., rely on solid functional substrates. The base plate may be formed by a solid substrate, for example.

In one embodiment, the microfluidic device comprises a third lateral channel part extending parallel to the cavity, wherein the third lateral channel part connects the first and second lateral channel parts and forms a flow path from the first lateral channel part to the second lateral channel part, which flow path is parallel to the flow path formed by the cavity. Thus, the third lateral channel part and the cavity form two parallel flow paths or channels above the sensor surface area. The cavity and the third lateral channel part may be designed to have different flow parameters, such as flow resistance and/or capillary force. Thus, when the third lateral channel part is separated from the sensor surface area by the cavity, the flow parameters of the cavity and/or the flow parameters of the first, second and third channel parts may be chosen as needed in order to provide fast and reliable measurements. For example, the flow parameters of the first, second and third lateral channel part may be substantially equal. For example, the third lateral channel part has a flow resistance $R_{c2}$ that is higher than a flow resistance $R_2$ of the cavity. Thus, when the cavity is completely filled, the liquid will flow mainly through the cavity. Nevertheless, the driving of the flow by capillary force may be determined by the flow parameters of the second lateral channel part, which may have the same structure as the third lateral channel part. For example, the porous capillary suction structure of the second lateral channel part may form the third lateral channel part and, optionally, may also form at least a part of the first lateral channel part. Therefore, the manufacturing tolerances are relaxed, in particular, the tolerances of size and position of the porous capillary suction structure. Thus, a simple manufacturing process of a reliable microfluidic structure is facilitated.

The term "flow resistance" is to be understood as being a physical quantity that is, for a given fluid viscosity, proportional to the pressure drop per unit length in flow direction required to maintain a given flow speed. Given the properties of the fluid/liquid, the flow resistance is fully dependent on geometric and structural parameters of a channel part or cavity, respectively. In particular, the term "flow resistance" is to be understood as meaning the flow resistance of a completely filled channel part or cavity, in particular filled with the liquid sample.

For example, the flow resistance $R_{c2}$ of the third lateral channel part may be substantially higher than the flow resistance $R_2$ of the cavity. For example, $R_{c2}/R_2$ may be of the order of 10 or higher. For example, $R_{c2}/R_2$ may be of the order of 100 or higher. Preferably, $R_{c2}/R_2$ is of the order of 1000 or higher.

This means that, for example, a flow resistance of a flow path from the first lateral channel part through the cavity along the sensor surface area to the second lateral channel part may be lower than the flow resistance of a flow path from the first lateral channel part through the third lateral channel part to the second lateral channel part.

For example, in one embodiment, the microfluidic device comprises a lateral channel formed by a porous capillary suction structure, said lateral channel extending along the first side of the base plate and along the cavity, said lateral channel comprising the first lateral channel part and the second lateral channel part. Furthermore, for example, the third lateral channel part is in open fluid communication with the cavity. For example, the third lateral channel part is at least at its upstream and downstream ends in open fluid communication with the cavity. For example, the third lateral channel part is at least in the first area and in the second area, where the cavity overlaps the first or second lateral channel part, respectively, in open fluid communication with the cavity. Thus, a lateral flow through the first and second lateral channel parts may be divided in two flow parts flowing in parallel through the third lateral channel part and through the cavity without being substantially diverted from a strictly lateral flow.

For example, the third lateral channel part is, along substantially the full length of the cavity in flow direction and/or along substantially the full length of the third lateral channel part, in open fluid communication with the cavity. For example, the third lateral channel part is at least between the first area and the second area in open fluid communication with the cavity. This facilitates filling the cavity and, thus, may accelerate the measurement. For example, the third lateral channel part is formed by a porous capillary suction structure. For example, the porous capillary suction structure of the second lateral channel part also forms the third lateral channel part.

For example, in one embodiment, the microfluidic device comprises a lateral channel formed by the porous capillary suction structure, said lateral channel extending along the first side of the base plate and along the cavity, said lateral channel comprising at least the third lateral channel part. For example, the lateral channel may comprise the third lateral channel part and the second lateral channel part. For example, the lateral channel may comprise the first lateral channel part. In particular, for example, the lateral channel may consist of the first, second and third lateral channel parts.

For example, the porous capillary suction structure may cover the cavity. For example, a vertical extension of the cavity is limited by the porous capillary suction structure. That is, the porous capillary suction structure is adjacent to the cavity. For example, the porous capillary suction structure limits a vertical extension of the cavity at a level that is substantially equal to a level of a surface of the first side of the base plate. For example, the structure forms a wall of the cavity, for example a top wall. When the porous capillary suction structure extends along the cavity, no other parts are necessary in order to delimit the cavity at its top side. Thus, a compact structure is provided. Nevertheless, due to the low flow resistance of the cavity, a high flow rate may be achieved in the cavity due to the capillary force exerted by the porous capillary suction structure of the second lateral channel part.

Thus, the advantages of porous media for flow control and reagent distribution may be combined in a simple manner with new sensors, for example, smooth surface sensors. When the lateral channel is formed by the porous capillary suction structure extending along the cavity, manufacturing the microfluidic device is simplified, and a reliable fluid transport may be provided.

In a further aspect of the invention, a lateral flow assay device is provided, which comprises a microfluidic device as described above. Thus, while retaining the ease of use and maturity of lateral flow assay devices known as such, a lateral flow assay device is provided that, for example, enhances and accelerates the washing step and, for example, allows the usage of new biosensors based on solid substrates.

In a further aspect of the invention, a method of using a microfluidic device as described above is provided, the method comprising the steps of:

- providing a sample fluid in a volume adjacent to the first lateral channel part, the sample fluid comprising a liquid sample,
- transporting the liquid sample through the first lateral channel part to the cavity by capillary force,
- transporting at least a part of the liquid sample through the cavity into the second lateral channel part by capillary force.

For example, the method comprises the step of the sensor performing detection of a substance in the liquid sample.

In a further aspect of the invention, a method of detecting a target molecule in a liquid sample is provided, the method comprising the steps of:

- providing a sample fluid in a volume adjacent to a first lateral channel part that extends along a first side of a base plate, the sample fluid comprising a liquid sample, transporting at least a part of the liquid sample through the first lateral channel part to a cavity, at least a part of said cavity being formed in the base plate, transporting, by capillary force, at least a part of the liquid sample through the cavity into a second lateral channel part that extends along the first side of the base plate and that comprises a porous capillary suction structure, at least a part of the liquid sample being transported, by capillary force exerted by the porous capillary suction structure, along a sensor surface area of a sensor, the sensor surface area being arranged in the cavity, detecting the presence of the target molecule at the sensor surface area.

The steps are not necessarily performed in the mentioned order. For example, the detecting step and the second transporting step may be performed in a different order and/or at least partly concurrently.

For example, the sensor is a biosensor. For example, the sample fluid may be a biological sample fluid, such as saliva.

In a further aspect of the invention, a method of manufacturing a microfluidic device is provided, the method comprising the steps of:

providing a base plate, which extends in a lateral plane and in which at least a part of a cavity is formed, said cavity extending at a first side of the base plate in a lateral direction from a first area to a second area, providing at least a first lateral channel part extending laterally along the first side of the base plate and overlapping the cavity at the first area, providing at least a second lateral channel part extending laterally along the first side of the base plate and overlapping the cavity at the second area, the second lateral channel part comprising a lateral channel part formed by a porous capillary suction structure, and arranging a sensor with a sensor surface area at the cavity, the sensor surface area being arranged towards the cavity, such that the cavity forms a flow path from the first lateral channel part along the sensor surface area to the second lateral channel part.

These and other aspects of the invention will be apparent from and illustrated with reference to the embodiments described hereinafter.

DETAILED DESCRIPTION OF EMBODIMENTS

Figure 1:
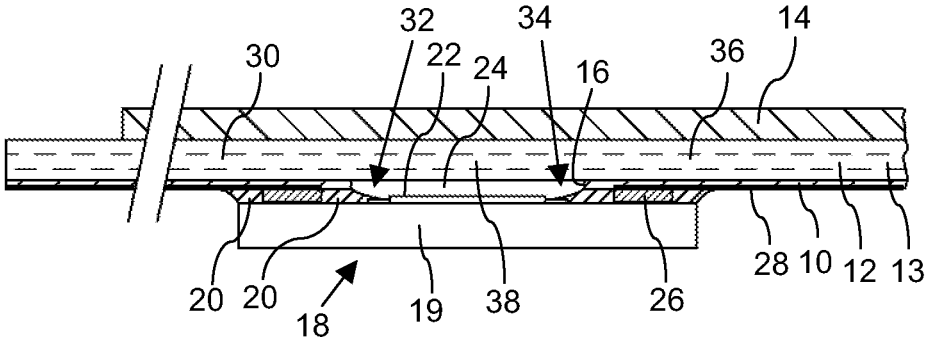
FIG. 1 schematically illustrates an exemplary construction of a microfluidic device for performing detection of a substance in a liquid sample according to the present invention.

The microfluidic device shown in FIG. 1 comprises a base plate or substrate 10, on a first side of which a membrane based lateral flow pad 12 having a porous capillary suction structure 13 is arranged. The lateral flow pad 12 is, for example, a porous medium or porous matrix, such as a paper-like material.

On top of the lateral flow pad 12, a top wall 14 is arranged. The lateral flow pad 12 defines a lateral channel for liquid transportation by capillary force.

The base plate 10 comprises a through-going opening 16. On the lower side of the base plate 10, a sensor 18 is arranged. A sensor substrate 19 of the sensor 18 is attached to the base plate 10, for example, through an electrically isolating substance 20. For example, the substance 20 is a bio-compatible glue, for example a resin. A sensor surface area 22 of the sensor 18 is arranged at the lateral flow pad side of the sensor 18, such that a cavity 24 is provided between the sensor surface area 22 and the lateral flow pad 12.

For example, the sensor 18 is an electrical or electronic sensor, and terminals of the sensor 18 are connected via electrical wires 26 to electrically conductive paths 28, which are provided at the bottom side of the base plate 10.

In FIG. 1, the sensor surface area 22 is recessed with respect to the top side of the base plate 10.

In the structure of FIG. 1, different channel parts formed by the lateral flow pad 12 and the cavity 24 may be distinguished. The lateral flow pad 12 comprises a first lateral channel part 30 extending laterally towards a first area 33 at a lateral end of the cavity 24. From a second area 34 at the opposite end of the cavity 24, a second lateral channel part 36 extends laterally to the right in FIG. 1. The second laterally channel part 36 is also formed by the lateral flow pad 12. The first and second lateral channel parts 30, 36 are connected by a third lateral channel part 38 formed by the lateral flow pad 12 and, parallel to the third lateral channel part 38, by the cavity 24, which extends laterally from the first area 32 adjacent to the first lateral channel part 30 to the second area 34 adjacent to the second lateral channel part 36. It is noted that in the example of FIG. 1, the third lateral channel part 38 formed by the lateral flow part 12 and the cavity 24 are in open fluid communication over their full respective lengths. In particular, the third lateral channel part 38 is immediately adjacent to the cavity 24. In particular, there is no further element separating them from each other.

Figure 2:
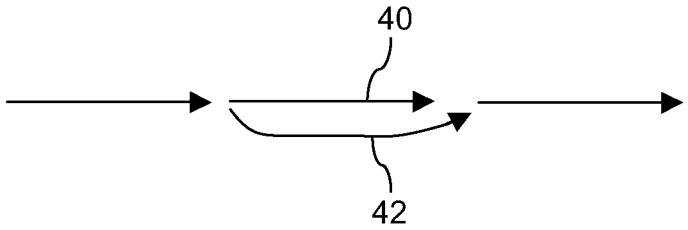
FIG. 2 schematically illustrates flow paths in the microfluidic device.

In this manner, two parallel flow parts are defined from the first lateral channel part 30 to the second lateral channel part 36, as is schematically illustrated in FIG. 2. A first or upper flow path 40 is provided by the third lateral channel part 38. A second or lower flow path 42 is defined by the cavity 24. For example, the flow paths 40, 42, i.e., the third lateral channel part 38 and the cavity 24, are arranged on top of each other above the sensor surface area 22. The interface between the lateral flow pad 12 and the cavity 24 forms a "virtual wall" separating the flow paths 40, 42. The cavity 24 separates the lateral flow pad 12 from the sensor surface area 22. Liquid transportation in the flow paths 40, 42 is governed by individual values of the capillary force and flow resistance of the two flow paths 40, 42.

In straight, unstructured channels, for example in the cavity 24, flow resistance and the capillary force are coupled via the channel height. In a micro- or nanoporous channel, e.g. such as formed by the lateral flow pad 12, however, the resistance and the capillary force are determined by the pore size or porosity. Here, the total flow rate Q may be adjusted independently via the channel height. For example, by choosing a large channel height, Q can be high even at a high flow resistance R. For example, a high total flow rate Q in the second lateral channel part 36 can be transferred to the low flow resistance cavity 24 to yield a higher flow rate than what would be achieved in the cavity channel alone, i.e. without an external pump. The two parallel flow paths 40, 42 into which the flow is split at the position of the sensor 18, are characterized by a high and low flow resistance R, respectively. For example, a flow resistance $R_1$ of the third lateral channel part 38, that is, the first flow path 40, may be higher than a flow resistance $R_2$ of the cavity 24 or second flow path 42.

When the cavity 24 and the third lateral channel part 38 are completely filled, the flow front will be controlled by the capillary force $F_c$ of the second lateral channel part 36 and the sum of the inverse of the flow resistances of the parallel flow paths 40, 42 upstream. The flow rate will be high in the low resistance part, that is, the second flow path 42, and the flow rate will be low in the high resistance part, that is, the first flow path 40. For example, the flow rates may substantially split according to the inverse ratio of the flow resistances, that is: $Q_2/Q_1=R_1/R_2$. Therefore, the flow rate in the low resistance part can accelerate rapidly as soon as the flow front has reached the end of the parallel paths 40, 42.

The sensor surface area 22 is arranged in the low resistance part. However, the total flow rate is determined by the characteristics of the common downstream part. The asymmetric resistance of the flow paths 40, 42 will lead to a strong flow enhancement in the low resistance part, that is, the cavity 24. When the cavity 24 has no porous structure, the convection at the sensor surface area 22 can be adjusted via the cavity or channel height at the sensor position. The flow rate will be high, and, accordingly, the convection at the sensor surface area 22 will be high. Thus, liquid can be replaced more easily. Thus, the measurement is sped up and the washing is improved. Thus, the background of the measurement is reduced.

FIGS. 3 to 6 schematically show the function of the microfluidic device of FIG. 1.

Figure 3:
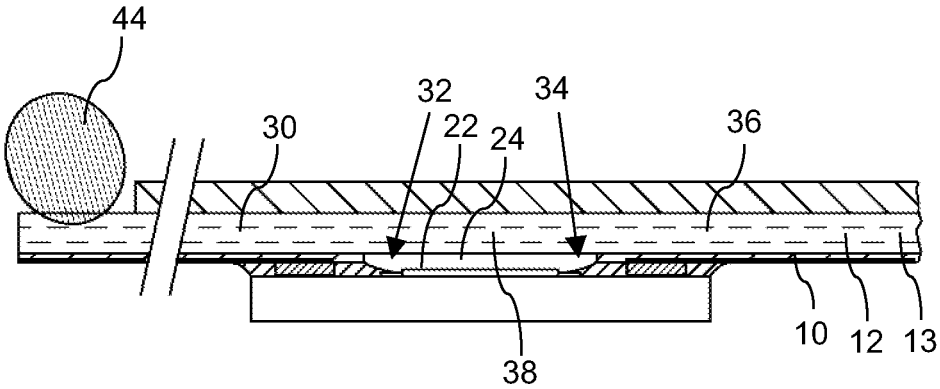
FIG. 3 illustrates a sample liquid being supplied to the microfluidic device.

In FIG. 3, a sample liquid 44 is applied to the first lateral part 30. The liquid sample 44 is transported along the first lateral channel part 30 by capillary force.

Figure 4:
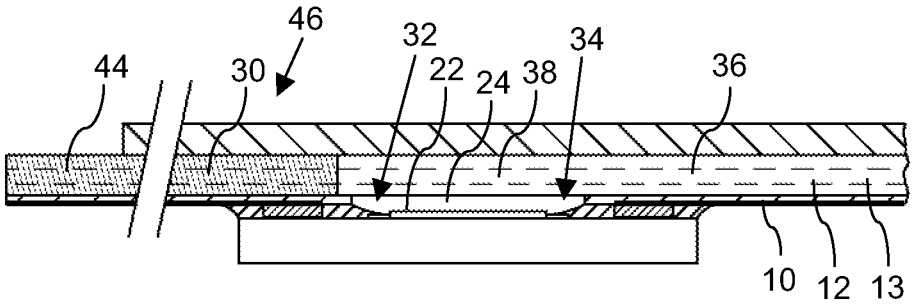
FIG. 4 illustrates the transport of the liquid sample along a first lateral channel part.
Figure 5:
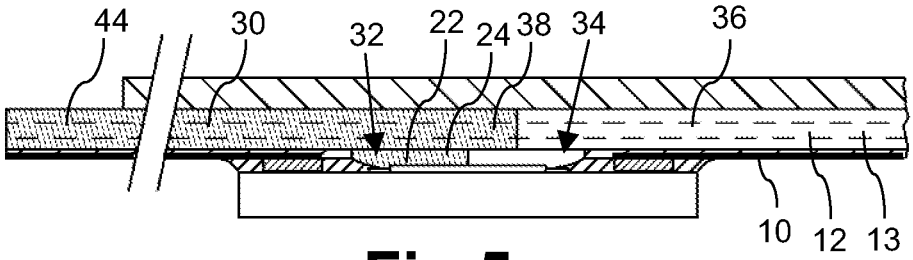
FIG. 5 illustrates the further transport of the liquid sample through a cavity, in which a sensor surface area is arranged, and through a third lateral channel part parallel to the cavity.

In FIG. 4, the sample liquid 44 has entered an entry section 46 of the microfluidic device. Then, the liquid flow is divided into the first flow part 40 along the third lateral channel part 38 and the second flow path along the cavity 24. The flow resistance of the cavity 24 is lower than the flow resistance of the third lateral channel part 38. Typically, the transport speed of the liquid belong the first flow path 40 may be different from the transport speed of the liquid along the second flow path 42, as is schematically shown in FIG. 5.

Figure 6:
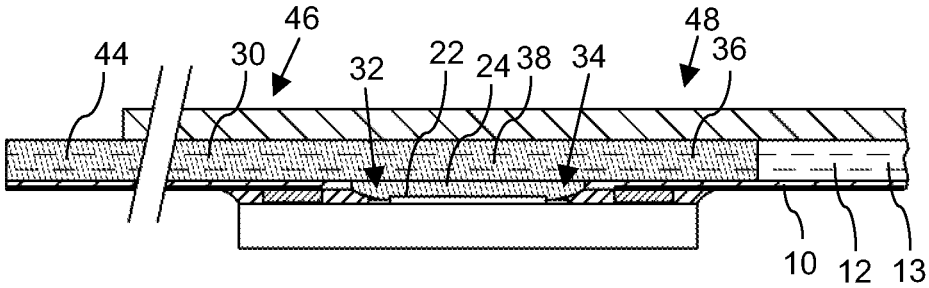
FIG. 6 illustrates the transport of the liquid sample into a second lateral channel part.

Once the cavity 24 is filled, the capillary force in the lateral flow pad 12 of the second lateral channel part 36 will attract liquid from the cavity 24, leading to an enhanced flow in the cavity 24 in comparison to the flow in the third lateral channel part 38, which is separated from the cavity 24 by a virtual channel wall. This situation is illustrated in FIG. 6, where the front of the sample liquid 44 has reached an exit section 48 of the microfluidic device.

In the embodiment described above, the flow resistance $R_{c1}$ of the first lateral channel part 30, the flow resistance $R_1$ of the third lateral channel part 38 and the flow resistance $R_{c2}$ of the second lateral channel part 36 are equal, that is: $R_{c1}=R_1=R_{c2}$. Furthermore, the respective capillary forces $F_{c1}$, $F_1$ and $F_{c2}$ are equal, that is: $F_{c1}=F_1=F_{c2}$. This is due to the fact that the common path and the first flow path 40 are made from the same porous capillary suction structure.

The low resistance part, that is, the second flow path 42 or cavity 24 does, for example, not contain a microstructured medium or a porous medium. Therefore, the background of residual labels will be low in the cavity 24 due to both a narrower residence time distribution of the liquid and a minimum channel surface for unspecific adsorption.

Thus, the volume of the flow system may be scaled via the volume of the lateral flow pad 12, while the flow rate at the sensor surface area 22 may be scaled via the ratio of flow resistances and the total flow rate. The latter is determined by the cross section of the common path, that is, the lateral flow pad 12, and by the capillary force.

The flow rate in the cavity (i.e. above the sensor) is adjusted by the flow rate in the exit section of the porous pad, i.e. the second lateral channel part 36, and the height of the cavity.

Typically, the pad 12 will create a flow front speed of 1 to several millimeters per second. With a speed of 1 mm/s, a thickness of 150 micrometers and a porosity of ⅓ the effective flow rate Q will be $1\times0.15/3=0.05\ mm^2/s$ per unit width. When connected to a cavity above the sensor of 50 micrometers height, the ratio of flow resistances $R_1/R_2$ can be of the order of 1000 or higher. This means that (after a certain length where transition effects are not dominating anymore) substantially all the liquid will flow through the cavity, yielding an average velocity of 1 mm/s. When the cavity is chosen 5 times smaller, e.g., the linear velocity will be 5 times higher. This is in contrast to a regular microchannel fluidic system where a reduction of the channel height leads to a reduction of the average velocity.

Figure 7:
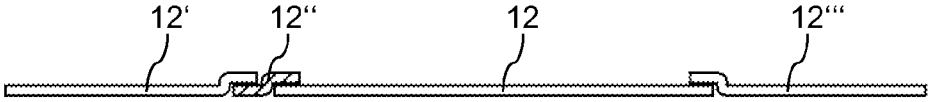
FIG. 7 schematically illustrates an exemplary construction of porous pads of a lateral flow assay device according to the invention.

FIG. 7 shows lateral flow pads 12 and 12', 12" and 12''' of a lateral flow immunoassay device according to the invention, the flow pads being formed by respective porous capillary suction structures 13. The lateral flow pads 12 and 12' to 12''' partly overlap at interfaces between the different pads.

For example, the lateral flow pad 12' is a sample pad for administering a sample liquid to the pad. The sample liquid contains a target analyst, that is, the substance to be detected.

In case of a non-competitive assay or sandwich-assay, for example, labels, which have been immobilized in the lateral flow pad 12", will dissolve and/or mix with the sample liquid when the liquid flows through the lateral flow pad 12". The target or antigens to be detected can react with primary antibodies attached to the labels while they are transported through the lateral flow pad 12 towards a sensor section 50 indicated in FIG. 8. Depending on the type of the sensor used, different labels may be provided, for example magnetic beads for a GMR sensor, fluorescent molecules or quantum dots for a fluorescence sensor, etc.

Figure 8:
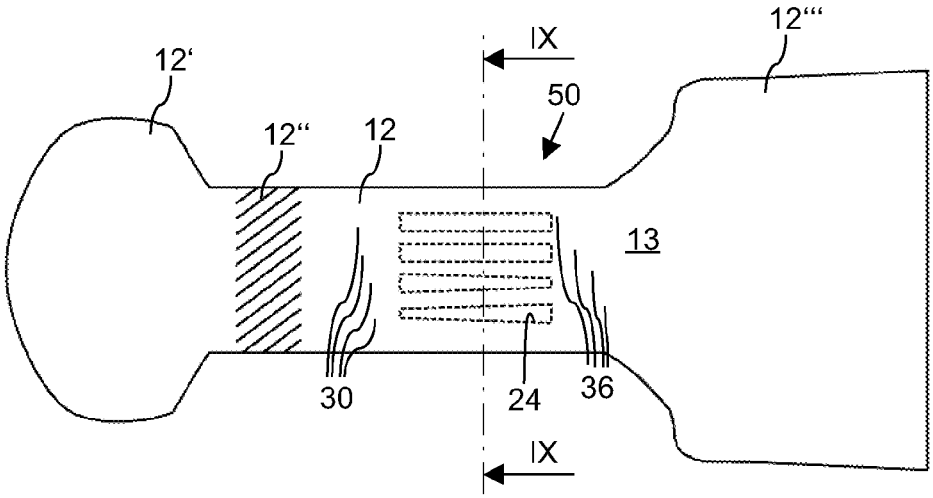
FIG. 8 is a top view of the porous pads of FIG. 6.
Figure 9:
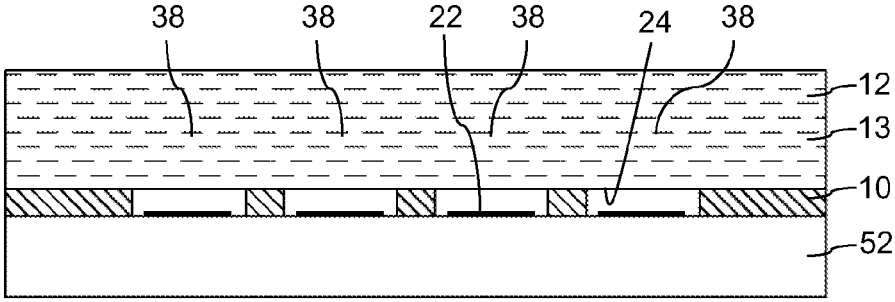
FIG. 9 is a schematic cross-sectional view of a lateral flow assay device according to the invention.

FIG. 9 shows a cross sectional view of the sensor section 50 along the line IX-IX in FIG. 8. The lateral flow pad 12 is arranged on top of the base plate 10. On the opposite side of the base plate 10, a sensor substrate 52 is arranged. For example, the base plate 10 is connected to the lateral flow pad 12 and to the sensor substrate 52 through adhesive layers.

As is indicated in FIGS. 8 and 9, multiple cavities 24 are formed in parallel in the base plate 10 between the lateral flow pad 12 and sensor surface areas 22 of sensors on the sensor substrate 52. The cavities 24 are arranged to form parallel flow paths, each of which corresponds to the lower flow path 42 of FIG. 2 and is parallel to a flow path that corresponds to the flow path 40 of FIG. 2 along the lateral flow pad 12. The parallel cavities 24 are arranged, in flow direction, between first lateral channel parts 30 and common second lateral channel parts 36 formed by the lateral flow pad 12. The first lateral channel parts 30 are in open fluid communication with their respective neighbor channel part(s) 30, and the second lateral channel parts 36 are in open fluid communication with their respective neighbor channel part(s) 36. Thus, in the arrangement of FIGS. 8 and 9, multiple parallel paths are provided in a single microfluidic device. Moreover, each second flow path 42 or cavity 24 may contain, for example, one or multiple sensor surface areas 22. Thus, an array of sensor surface areas 22 may be provided. For example, on each sensor surface area 22, specific secondary antibodies may be immobilized for attaching to different antigens to be detected. For example, multiple specific primary antibodies attached to the labels may be provided in the lateral flow pad 12". It is noted that in the example of FIGS. 8 and 9, the respective cavities 24 and the respective third lateral channel parts 38, which are formed by the lateral flow part 12 above the respective cavities 24, are in open fluid communication over their full respective lengths.

As is schematically indicated in FIG. 8, the cross section of the cavity 24 may vary in flow direction. For example, when the width of the cavity 24 changes in flow direction, the local flow rate above the sensor surface area(s) can be varied.

Furthermore, the cross-section of the lateral flow pad 12 forming the second lateral channel part 36 may be varied in flow direction. For example, when the width of the lateral flow pad 12 varies in flow direction, the flow rate may vary in time. For example, in FIG. 8, the width of the lateral flow pad 12'" downstream of the sensor section 50 is substantially larger than the width of the lateral flow pad 12 upstream of the sensor section 50. Thus, for example, when the cavities 24 are completely filled, a higher flow rate is provided than before filling the cavity 24.

For example, the lateral flow assay device of FIGS. 7 to 9 may be part of a biosensor apparatus, such as a sensor cartridge, for example a disposable biosensor cartridge. For example, the biosensor cartridge may comprise a filter for filtering a sample fluid. For example, a filter may be arranged to remove blood cells from blood or gelating proteins from saliva.

The embodiments described above may be used in existing assay procedures in a substantially unaltered manner as compared to conventional lateral flow assay devices. Moreover, the invention has the advantage of a much more sensitive detection and a shorter washing time. Both effects will speed up the analysis significantly.

The microfluidic device according to the invention is very versatile. For example, displacement and/or competitive assays can be carried out additionally or alternatively to sandwich or non-competitive assays.

Applications of the invention are, for example, diagnostic tests for screening, home- or point-of-care testing, based on proteomic, genomic or metabolomic markers, drug testing, etc., as well as environmental tests, food quality testing, etc. with a variety of types of samples, like blood, serum, plasma, saliva, tissue extracts, from humans or animals, as well as any other sample or prepared analyte for the desired purpose of analysis.

While the invention has been illustrated and described in detail in the drawings and foregoing description, such illustration and description are to be considered illustrative or exemplary and not restrictive. The invention is not limited to the disclosed embodiments.

Variations to the disclosed embodiments can be understood and effected by those skilled in the art in practicing the claimed invention, from a study of the drawings, the disclosure, and the appended claims.

For example, different porous capillary suction structures, e.g. different porous materials, may be combined for different sections of the lateral flow pad 12 and/or the individual lateral flow pads 12, 12', 12", 12'", as is known as such in the art.

For example, the sensor 18 may be an optical sensor, and the substrate 19 may be a transparent substrate.

For example, alternatively or additionally to antibodies with labels attached to them, separate labels mixed with the sample fluid may be provided. For example, the lateral flow assay device may be adapted to provide an incubation time in order to allow binding of antibodies and/or labels to the antigens to be detected. For example, in the example of FIG. 8, incubating time is provided for by providing a transport time of the sample liquid between the pad 12" and the sensor section 50.

Furthermore, all the disclosed elements and features of the described methods or devices can be combined with, or substituted for, the disclosed elements and features of the described devices or methods, except where such elements or features are mutually exclusive. The mere fact that certain measures are recited in mutually different dependent claims does not indicate that a combination of these measures cannot be used to advantage.

In the claims, the word "comprising" does not exclude other elements or steps, and the indefinite article "a" or "an" does not exclude a plurality. Any reference signs in the claims should not be construed as limiting the scope.

The invention claimed is:

1. A microfluidic device for performing detection of a substance in a liquid sample, the device comprising:

a base plate;

a first lateral channel part extending along a first side of the base plate;

a second lateral channel part extending along the first side of the base plate, wherein the second lateral channel part comprises a porous capillary suction structure;

a sensor having a sensor surface area, wherein a cavity is formed above the sensor surface area, at least a part of the cavity being formed in the base plate, wherein the cavity extends at the first side of the base plate from a first area, wherein the cavity overlaps the first lateral channel part, to a second area, wherein the cavity overlaps the second lateral channel part, and wherein the cavity forms a flow path from the first lateral channel part along the sensor surface area to the second lateral channel part;

wherein the porous capillary suction structure is adapted to exert a capillary force $F_c$ on the liquid, and wherein the cavity is adapted to exert a capillary force $F_2$ on the liquid, $F_c$ being greater than $F_2$.

2. The microfluidic device as claimed in claim 1, wherein the cavity has a structure that is adapted to transport the liquid by capillary suction.

3. The microfluidic device as claimed in claim 1, wherein the sensor is an electronic sensor and/or an optical sensor.

4. The microfluidic device as claimed in claim 1, further including a third lateral channel part extending parallel to the cavity and connecting the first and second lateral channel parts, the first, second, and third lateral channels being formed by the porous capillary suction structure.

5. The microfluidic device as claimed in claim 4, wherein a vertical extension of the cavity is limited by the porous capillary suction structure.

6. A lateral flow assay device, comprising the microfluidic device as claimed in claim 1.

7. A microfluidic apparatus for detecting a substance in a liquid sample, the apparatus comprising:

a base plate, the base plate defining a first side;

a first lateral channel part extending along the first side of the base plate;

a second lateral channel part extending along the first side of the base plate, the second lateral channel part being formed by a porous capillary suction structure, the porous capillary structure being configured to exert a capillary force $F_c$ on the liquid;

a sensor having a sensor surface area, the sensor being mounted to the base plate recessed from the first side such that a cavity is formed between the sensor surface area and the base plate first side, at least a part of the cavity being formed in the base plate, the cavity extending from a first area overlapping the first lateral channel part to a second area overlapping the second lateral channel part, the cavity being configured to exert a capillary force $F_2$ on the liquid to transport the liquid across the sensor surface area by capillary suction, the force $F_c$ being greater than the force $F_2$.

* * * * *